United States Patent [19]

Tjomsland

[11] Patent Number: 4,841,673

[45] Date of Patent: Jun. 27, 1989

[54] SECURITY WINDOW SYSTEM

[76] Inventor: Bryan J. Tjomsland, 4277 Verduge View Dr., Los Angeles, Calif. 90065

[21] Appl. No.: 86,703

[22] Filed: Aug. 18, 1987

[51] Int. Cl.[4] ..... E05B 65/10

[52] U.S. Cl. ..... 49/141; 49/449

[58] Field of Search ..... 49/141, 394, 449, 450, 49/50, 57

[56] References Cited

U.S. PATENT DOCUMENTS

| | | | |
|---|---|---|---|
| 683,650 | 10/1901 | Knisely . | |
| 959,081 | 5/1910 | Simmons . | |
| 972,769 | 10/1910 | Lark . | |
| 1,073,268 | 9/1913 | McLaughlin . | |
| 1,287,529 | 12/1918 | Vilardo . | |
| 1,958,731 | 5/1934 | Voegelein . | |
| 2,145,968 | 2/1939 | Bozarth . | |
| 2,200,346 | 5/1910 | Sepull . | |
| 2,237,658 | 4/1941 | Dyke . | |
| 2,548,242 | 4/1951 | Rosenbarger . | |
| 2,874,986 | 2/1959 | Henrichs . | |
| 3,498,658 | 3/1970 | Steenstra et al. . | |
| 4,019,281 | 4/1977 | Weiler | 49/141 X |
| 4,106,239 | 8/1978 | Bancroft et al. | 49/449 |
| 4,127,966 | 12/1978 | Schmidt | 49/141 |
| 4,320,597 | 3/1982 | Sterner, Jr. | 49/449 |
| 4,452,011 | 6/1984 | Trombettas | 49/449 |
| 4,587,759 | 5/1986 | Gray | 49/450 X |
| 4,638,596 | 1/1987 | Gallardo | 49/141 |

FOREIGN PATENT DOCUMENTS

| | | | |
|---|---|---|---|
| 38471 | 12/1923 | Norway | 49/450 |

*Primary Examiner*—Kenneth J. Dorner
*Assistant Examiner*—James R. Brittain
*Attorney, Agent, or Firm*—Christie, Parker & Hale

[57] ABSTRACT

A security window includes a movable window sash having an outer frame subdivided by strong metal cross-bars into small spaces for window panes too small to allow entry through the window sash by an intruder breaking the glass. The window sash slides vertically or horizontally in metal channel-shaped fixed wall frame members that permit the sash from being pried loose. A spring-loaded locking bolt is contained in a cylinder mounted interiorly of the wall in wall studs next to the window. The locking bolt is connected to an elongated rigid metal control rod extending interiorly through the wall, preferably through intervening wall studs, to a lever arm and crank mechanism in a remote location within the wall sufficiently far from the window that the lever arm cannot be reached through a broken window pane by an outside intruder. A return spring holds the locking bolt in a positive locked position engaged within aligned detents in the fixed outer window frame member and in the window sash frame. The window can be opened by the homeowner manually rotating the remote lever arm to retract the control rod and thereby move the locking bolt from its locked position in the aligned detents against the bias of the return spring to allow the window sash to slide or pivot open. Moving the window sash forcefully to its closed position automatically snaps the locking bolt into its locked position.

17 Claims, 4 Drawing Sheets

SECURITY WINDOW SYSTEM

FIELD OF THE INVENTION

This invention relates to a security window system that avoids the serious risks of providing windows with rigidly attached iron bars.

BACKGROUND OF THE INVENTION

Steel bars are often used over windows in the home to provide security. However, it is now commonly known that steel bars are exceedingly dangerous because persons inside the home often cannot escape through the windows from a fire inside the house. Many local building and fire codes now do not allow use of iron security bars rigidly affixed over the windows. One local code requires an approved escape window in each bedroom. Generally, iron bars for guarding a window must be provided with a release mechanism for opening the bars manually without the use of additional tools. Currently, security bars are released with cable or pedal mechanisms mounted on the interior surface of the wall, and with simple catches on the window frame. The most common simple release mechanism is a through-wall catch mounted immediately next to the window. Some of these security window unlocking mechanisms can be reached from the outside by an intruder. Others must be reset, after opening, by trained persons. The result is that many of these security systems using iron bars over the windows cannot be used as a normal window, they do not have the appearance of a normal window, and they do not always provide the necessary security.

Alternatively, home security systems have included the usual alarm systems which, if not installed, used and maintained properly, can create false alarms. As a result, security still becomes a problem, not to mention a nuisance to the neighbors.

The present invention provides a security window system which has the appearance of a normal window and is usable in a manner similar to a normal window. The security window of this invention can be used with vertically sliding windows or with hinged windows, as well as other window styles, without requiring separate iron bars over the outside of the windows. And yet the security system prevents an intruder from entering through the window even if the window glass has been broken. Further, the intruder cannot unlock and open the security window from the outside if the window glass is broken.

SUMMARY OF THE INVENTION

Briefly, the security window system of this invention includes a movable window sash having an outer frame subdivided by strong metal cross-bars into small spaces for window panes too small to allow entry through the window sash by an intruder breaking the window glass. In one embodiment, the window sash slides vertically in metal channel-shaped fixed wall frame members that prevent the sash from being pried loose. Alternatively, the movable window sash can be hinged to pivot from an open position to a closed position in the fixed metal channel-shaped window frame member. In a further embodiment, the invention can be adapted to use with a horizontally sliding window. A spring-loaded locking bolt is mounted interiorly of the wall next to the window. An elongated rigid control rod extends interiorly through the room wall from a locking bolt release mechanism in a remote location within the wall sufficiently far from the window that it cannot be reached through a broken window pane by an intruder on the outside. The locking bolt is normally maintained in a locked position engaged with aligned detents in the fixed outer window frame member and in the movable window sash. This prevents the window from being opened. The window can be opened by the homeowner manually by activating the release mechanism which retracts the control rod to remove the locking bolt from its locked position sufficiently to allow the window sash to slide open or to pivot open.

These and other aspects of the invention will be more fully understood by referring to the following detailed description and the accompanyng drawings.

DETAILED DESCRIPTION

Figure 1:
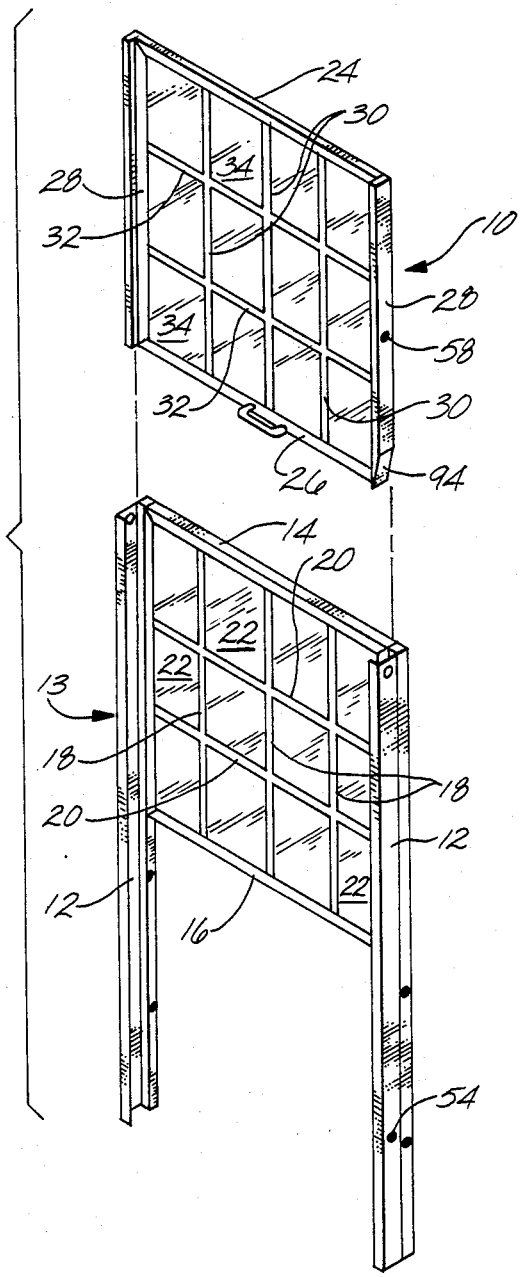
FIG. 1 is a semi-schematic exploded perspective view illustrating one embodiment of the security window system as used in a vertically sliding window.

A security window system of this invention, in one embodiment, includes a vertically sliding window sash 10 which mounts in vertical slider tracks formed by metal channel-shaped frame members 12 of a fixed window frame 13. The window sash 10 and the fixed window frame 13 are both made of metal with their component parts welded together to form a rigid unit that provides security for the window opening. The window formed by the window sash 10 and fixed frame 13 is adapted to replace a conventional double hung window by bolting into existing window openings, or the security window can be used in new construction. The vertically sliding window sash is free to travel up and down in the tracks 12. In the illustrated embodiment the vertically slidable window sash is opened and closed manually. The window sash can be engaged with a counterbalance mechanism, in the upper corners of the windows, in the well-known manner. The invention also can be used with a hinged window which pivots open, or with a horizontally sliding window, for example. The fixed window frame shown at 13 includes a fixed upper window formed between an upper rigid cross-member 14 at the top of the window and a lower rigid cross-member 16 at about the mid-point of the window. The ends of the crossmembers 14 are rigidly affixed by welding to the channel members 12. The fixed upper window is subdivided into small window panes by vertical and horizontal rigid metal cross-members 18 and 20, respectively, rigidly affixed to one another and also rigidly affixed at their ends to the channels or to the upper and lower frame members 14 and 16. Panes 22 of window glass are glazed into the open spaces between the cross-members 16 and 18 in the usual manner. The vertically sliding window sash 10 opens and closes the lower half of the fixed window frame. The window sash includes an upper rigid cross-member 24 spaced above a lower rigid cross-member 26, together with vertical side members 28 all welded together as a rigid unit. In addition, the window sash includes vertical and horizontal cross-members 30 and 32 welded to each other and at their ends to the rectangular outer rigid frame to provide a rigid security unit for the lower half of the window opening. The window sash also includes panes 32 of window glass closing off the spaces between the vertical and horizontal cross-members in the usual manner. The vertical and horizontal cross-members 18 and 20 of the fixed upper window and the vertical and horizontal cross-members 30 and 32 for the window sash are preferably made from T-shaped steel members preferably between $\frac{1}{8}$ inch and $\frac{3}{8}$ inch thick; and the outer frame members of the fixed upper window and the lower sash are made from steel angle members also between approximately $\frac{1}{8}$ inch to 3/16 inch thick. An exception is the outer vertical side members 28 of the window sash 10 which are tubular members of rectangular cross-section best illustrated in FIG. 3.

As mentioned above, the security window system also can be used with hinged window sashes which pivot open or to a closed position in the fixed outer window frame. In the hinged window sash, the interior space within each window frame of the sash also is subdivided into the small window panes preferably by the vertical and horizontal rigid metal cross-members. Other window styles also can be accommodated by the security window system of this invention as long as at least the opening portion of the window is subdivided into the smaller window pane areas by the rigid metal vertical and horizontal cross-members. Of course, it is preferred that the entire window, the opening portion and any associated closed portion, both be subdivided into the small sections by the fixed, rigid cross-bars.

The rigid cross-members are spaced apart by a distance that provides window pane openings which are too small to allow entry through the window sash by an intruder when the glass in the window sash has been broken. Window panes about 8 to 10 inches wide (in both horizontal and vertical dimensions) are preferred.

Figure 2:
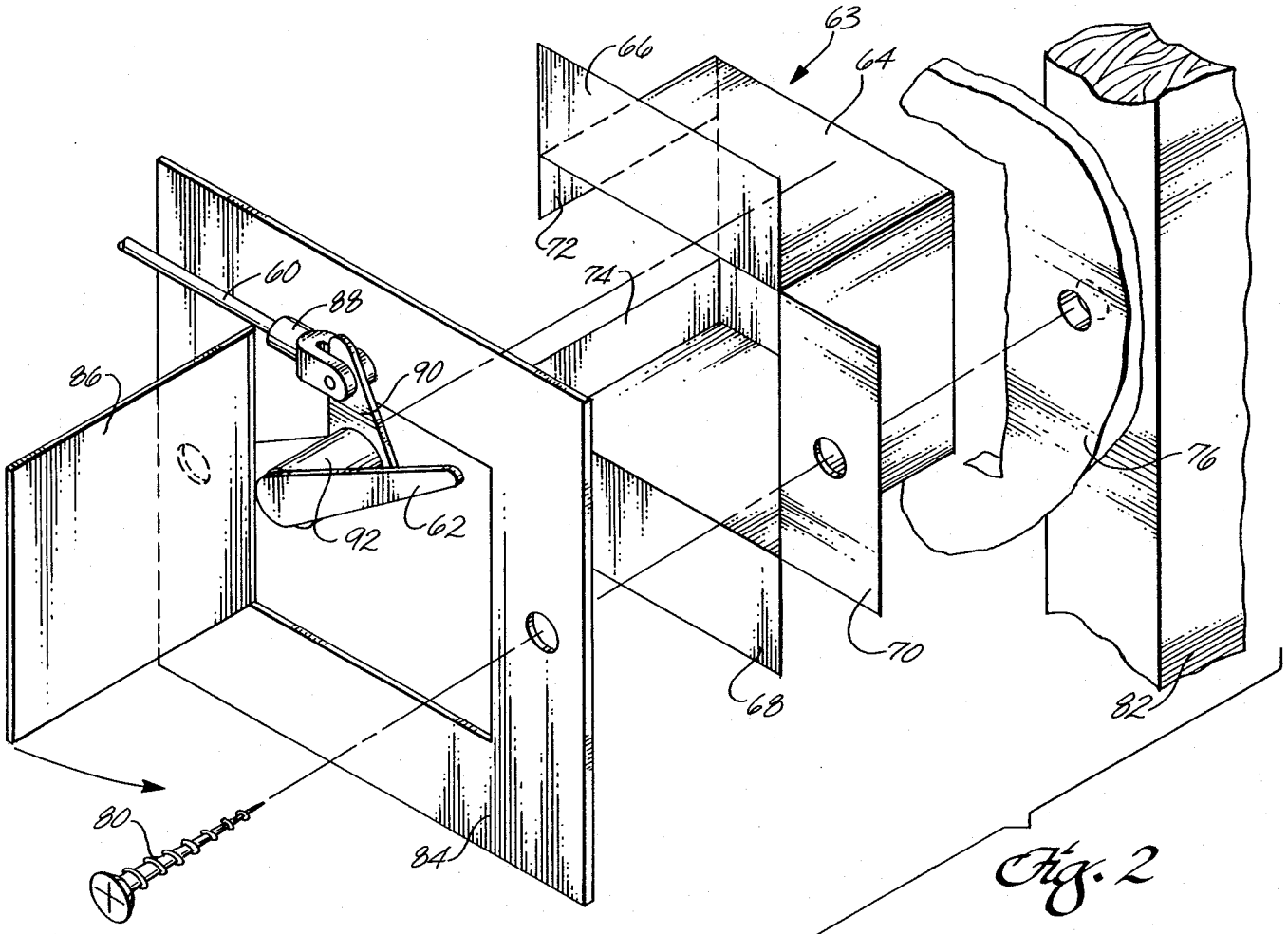
FIG. 2 is a semi-schematic fragmentary exploded perspective view illustrating a locking bolt linkage.
Figure 3:
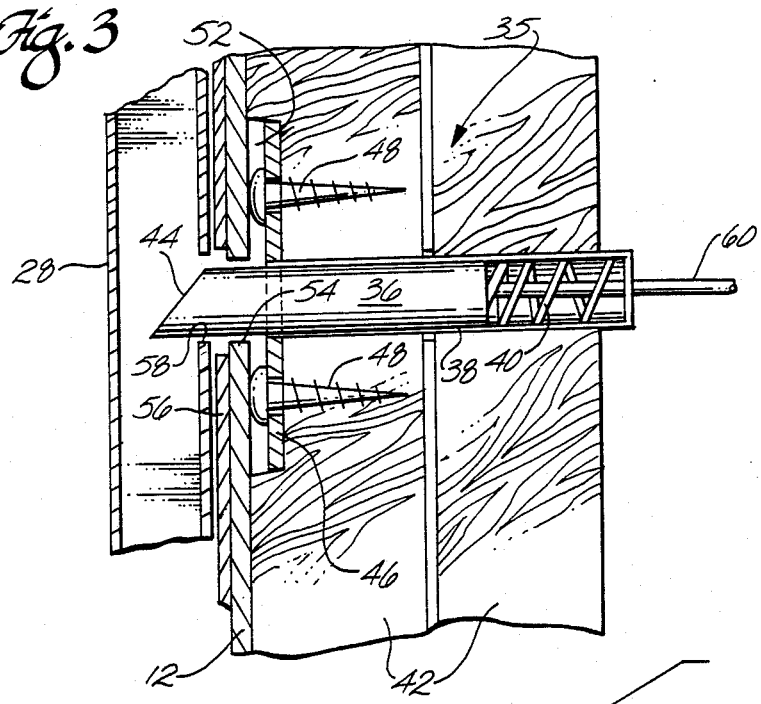
FIG. 3 is a semi-schematic fragmentary cross-sectional view illustrating use of the locking bolt with the security window system in the vertically sliding window.
Figure 4:
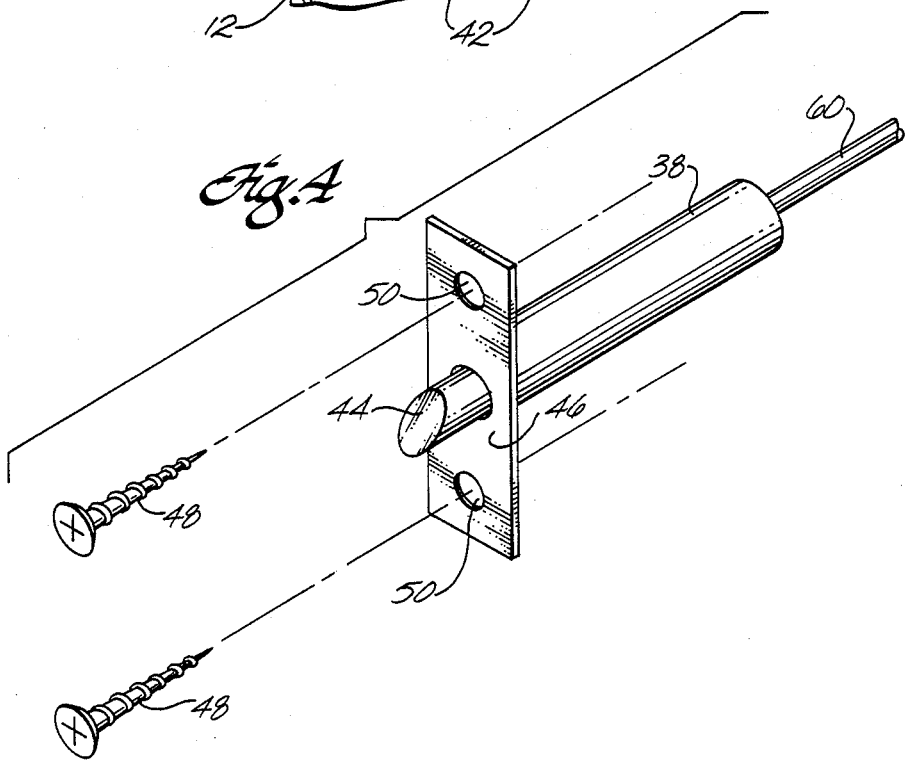
FIG. 4 is a fragmentary exploded perspective view illustrating mounting of the locking bolt and cylinder.

FIGS. 2 through 4 illustrate installation of a securit lock and linkage for controlling locking and unlocking of the window sash 10. The locking system includes a locking bolt 36 which slides within an outer cylinder 38. The inner end of the bolt engages a coil spring 40 inside the cylinder for normally urging the bolt out of the cylinder. The cylinder is installed in a hole drilled in conventional double window studs 42. The outer end of the bolt has a tapered edge 44. The cylinder 36 mounts in the studs with a rigid vertical guide plate 46 affixed to the studs by fasteners 48 extending through holes 50 in the plate. The guide plate is affixed inside a shallow cavity 52 mortised from a face of the wall stud closest to the window opening. The end of the locking bolt projects through a hole or detent 54 in the metal channel member 12 of the fixed outer window frame 13. The locking bolt also passes through an opening in a strip 56 of nylon tape which lines the base of the channel 12 to provide a slippery, smooth low-friction surface on which the window sash can slide up and down. The locking bolt in its locked position shown in FIG. 3 also passes through an aligned hole or detent 58 in the vertical face of the tubular frame member 28 of the window sash. This tubular member normally slides on the nylon tape 56 in the channel 12. In the locked position of the locking bolt 36 shown in FIG. 3, the locking bolt passes through the hole 58 in the window sash and into the interior of the tubular frame 28 of the window sash and is held in this locked position to prevent the window sash from sliding in its outer track 12. This locks the window sash in its closed position. Inasmuch as the locking portion of the locking bolt is contained inside the interior of the tubular frame 28, an intruder from the outside of the window cannot gain access to the locking bolt to unlock it.

The locking bolt reciprocates in the cylinder between its locked position and a released position, under the control of an elongated rigid metal control rod 60 and a remote release mechanism. One end of the control rod 60 extends into the interior of the cylinder and is rigidly affixed to the end portion of the locking bolt remote from its tapered end surface 44. The control rod 60 extends from the locking bolt a considerable distance from the window sash through the interior of the wall to a release mechanism shown in FIG. 2. The release mechanism includes a lever arm 62 which is manually operated to control movement of the locking bolt to unlock the window. The release lever 62 for the control rod 60 is located at a distance sufficiently far from the window that the release lever cannot be reached by an intruder on the outside who has broken the glass in the security window.

Although there are various means for installing the control rod release lever mechanism in an interior wall, FIG.2 illustrates one embodiment in which the release lever 62 is contained within a generally rectangularly shaped housing 63 which includes a sheet metal box 64 mounted in the side wall. The box includes thin metal flanged upper and lower faces 66 and 68, a flanged face 70 at one side of the box, and a pair of vertically spaced apart short flanged faces 72 and 74 on the opposite side of the box for forming an opening in the side of the box closest to the control rod. The flanged exterior faces 66, 68 and 70 of the box are flush-mounted to the wall plaster 76 and attached to the wall by mounting bolts 80 which extend into a wall stud 82. The box is also flush mounted to the wall by a rectangular sheet metal outer frame 84 with an opening closed by a door 86. The lever arm 62 and its associated linkage and the control rod are mounted inside the interior of the box 64. The control linkage includes a yoke 88 at the end of the control rod pivotally connected to a short crank arm 90 rigidly affixed to and projecting from a rotatable base 92 of the lever arm 62. A pivot for the rotatable base 92 is mounted inside the interior of the box 64 so as to hold the crank mechanism in a fixed position inside the box. The control rod 60 extends through the open space between the flanged faces 72 and 74 of the box to the locking bolt shown in FIG.3. When the door 86 is closed flush against the wall the release lever 62 is hidden from view.

The door 86 can be opened for the homeowner to gain access to the release mechanism for unlocking the locking bolt. Preferably this is accomplished by rotating the lever arm 62 downwardly in FIG. 2 to pull the control rod 60 in a direction to the right in FIG. 2 which, in turn, retracts the locking bolt (at the opposite and of the control rod 60) into the cylinder 38, against the bias of the return spring 40, far enough so that the end of the locking bolt does not protrude through the opening 58 of the window sash member 28. This releases the window sash for sliding up or down in the window track 12. The return spring inside the locking bolt cylinder supplies the force required to extend the locking bolt into the sliding frame. When the window is open, the bolt and spring are compressed into the retracted position (except when the slider frame is completed, clear of the locking bolt, i.e., in the wide open position). When the window sash is forcefully closed, the holes in the sash and frame align and the bolt snaps into the locked position. The release mechanism and control rod are not used to lock the window. When the bolt automatically extends into the locked position, the control rod automatically follows it. The face 44 of the locking bolt is tapered so that the bolt can be easily depressed (forced into the cylinder against the bias of the return spring) by contact between the end of the locking bolt and the vertical face of the sliding window sash frame 28 (or by a striker plate on a hinged window). The window sash thus can be moved to a positive locked position from its unlocked position by simply sliding the window sash from its open position to its closed position in which the holes in the sliding vertical frame 28 and the fixed frame 12 are aligned so the locking bolt can automatically snap into its locked position. When sliding the window sash downwardly toward the locking bolt, a tapered bottom 94 of the vertical window frame engages the tapered end of the locking bolt to compress the bolt into the cylinder. The bolt then is held in tension against the outer tubular frame 28 of the window sash until the locking holes 54 and 58 line up for locking the window sash with the locking bolt. On the window there is a normal small level of resistance against the weather stripping when the window is closed tightly. When the control rod retracts the locking bolt, even momentarily, the holes come out of alignment, the locking bolt will not reengage, and the window will then remain unlocked until forcefully closed again.

The release mechanism can be retrofitted into existing wall studs without disturbing existing wall board or plaster, or it may be installed in new construction. The door of the housing for the release mechanism provides an additional means of security to bar access by an intruder as well as providing a flush wall finish. Although the lever arm and its linkage could be eliminated with the use of an electrically controlled solenoid bolt for moving the locking bolt and a remote electrical switch for controlling the solenoid, this can be undesirable for fire escape windows because of the dependence upon electrical power for escape. The release lever can require very little manually-applied force to rotate it between its locked and unlocked position.

Figure 5:
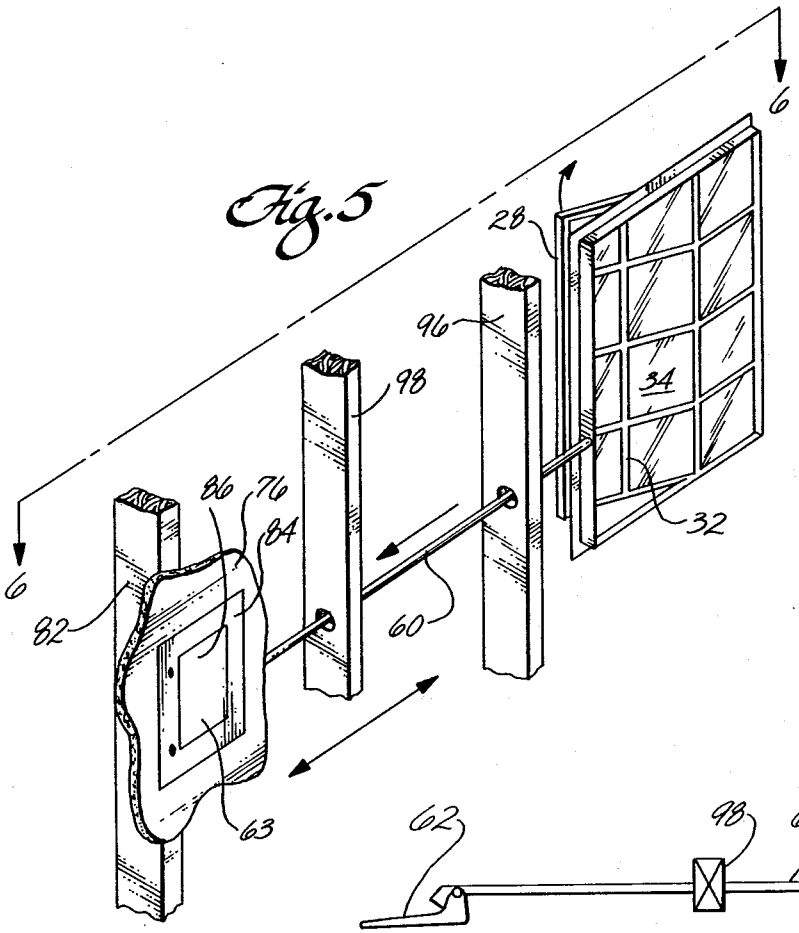
FIG. 5 is a fragmentary schematic perspective view illustrating the security window system in use in an embodiment in a hinged window.
Figure 6:
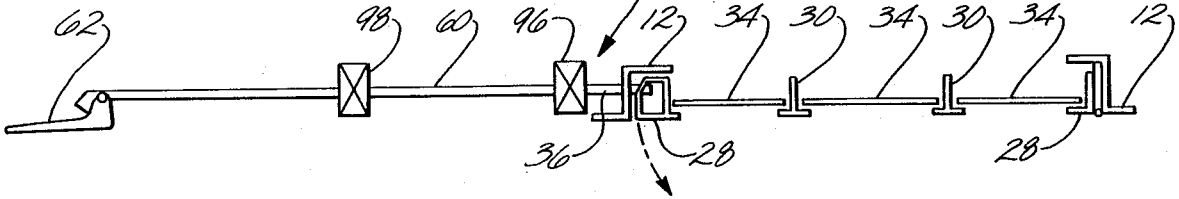
FIG. 6 is a schematic top view of the security window system taken from line 6—6 of FIG. 5.

FIGS. 5 and 6 schematically illustrate installation of the security window system which should now be apparent from the description above. In the embodiment of FIGS. 5 and 6, a hinged window sash is shown on one side of the window to illustrate an alternative window style in addition to the vertically sliding window described above. The security window system is shown installed with the release lever contained inside the housing 63 that has been flush-mounted to the wall 76 and rigidly affixed to a remote wall stud 82. The control rod 60 is shown extending through drilled holes in several intervening wall studs 96 and 98 so that the release mechanism for the control rod is located on the wall sufficiently far from the window opening that it cannot be reached by an intruder reaching through the window. The locking bolt assembly is shown with the locking bolt 36 secured to the tubular frame member 28 for holding the window sash in its locked position.

A similar control rod activated release mechanism and locking bolt assembly can be used to lock and unlock a vertically movable bolt engaged with bottom of a horizontally slidable window.

Thus, the security window system provides strong metal cross-members subdividing the window into smaller window panes of a size that prevents entry through the window by an intruder from the outside. The movable window sash portion of the security window is locked by a locking mechanism which is contained in the interior of the window frame and therefore cannot be reached by the intruder. Moreover, the control rod for the locking bolt is mounted interiorly of the wall and extends to a remote location on the wall sufficiently far from the window that it cannot be reached by an intruder who has broken the glass in the window. The result is a security window having the appearance of a normal window and in which the window is used in a manner similar to a normal window and yet substantial security is provided.

What is claimed is:

1. A safety window comprising:

a window sash having a movable outer frame with rigid cross-bars within the outer frame for forming spaces for window panes of a size too small to permit entry through the window sash by an intruder, a fixed window frame rigidly affixed in a wall of a dwelling, means for movably securing the window sash in the fixed window frame so the window sash moves relative to the fixed window frame between a close position and an open position, a locking bolt mounted adjacent to the fixed window frame and movable between a locked position and an unlocked position, in which the bolt in its locked position is engaged with the fixed window frame and the outer frame of the window sash to prevent the window sash from moving to its open position, and in which the bolt in its unlocked position allows the window sash to move relative to the fixed window frame to an open position;

an elongated control rod secured to the locking bolt and extending interiorly through the wall of the dwelling for a distance spaced from the window to a remote position inaccessible to an intruder reaching through the window sash, in which the control rod in the wall passes through at least one wall stud spaced remotely from the side of the window frame; and means for moving the control rod manually from said remote position for moving the control rod to release the locking bolt to permit the locking bolt to move from its locked position to its unlocked position, allowing the window sash to be moved to its open position.

2. Apparatus according to claim 1 in which the means for moving the control rod comprises a crank mechainsm mounted interiorly in the dwelling wall and comprising a lever arm connected to pivot means so that manually applied force to the lever arm rotates the crank to move the control rod to its unlocked position.

3. Apparatus according to claim 2 in which the lever arm is contained in a housing mounted interiorly in the dwelling wall with a closable door over the front of the housing.

4. Apparatus according to claim 1 in which the window sash outer frame and cross bars in the sash frame are made of metal.

5. Apparatus according to claim 4 in which the fixed window frame is made of metal.

6. Apparatus according to claim 1 including spring means for normally urging the locking bolt toward its locked position, and the control rod moves the bolt against the bias of the spring means.

7. Apparatus according to claim 1 including a rigid control rod.

8. A safety window comprising:

a window sash having a movable outer frame with rigid cross-bars within the outer frame for forming spaces for window panes of a size too small to permit entry through the window sash by an intruder;

a fixed window frame for mounting in a wall of a dwelling, means for movably securing the window sash to the fixed window frame so the window sash moves relative to the fixed window frame between a closed position and an open position, a locking bolt for mounting adjacent the fixed window frame and movable between a locked position and an unlocked position, in which the bolt in its locked position is engageable with the fixed window frame and the outer frame of the window sash to prevent the window sash from moving to its open position, and in which the locking bolt in its unlocked position allows the window sash to move relative to the fixed window frame to its open position, an elongated control rod secured to the locking bolt and extendable interiorly through the wall of the dwelling for a distance spaced from the window frame and window sash to a remote position inaccessible to an intruder reaching through the window, in which the control rod in the wall passes through at least one wall stud remotely from the side of the window frame, and means for moving the control rod manually from said remote position for moving the control rod to release the locking bolt to permit the locking bolt to move to its unlocked position, allowing the window sash to be moved to its open position.

9. Apparatus according to claim 8 in which the cross bars of the window sash are made of metal.

10. Apparatus according to claim 9 in which the fixed window frame and the window sash frame are made of metal.

11. Apparatus according to claim 10 in which the window sash frame is tubular for holding the locking bolt in the interior of the tubular frame member when the locking bolt is locked.

12. Apparatus according to claim 8 including spring means for normally urging the locking bolt toward its locked position, and the control rod moves the bolt against the bias of the spring means.

13. Apparatus according to claim 8 including a rigid control rod.

14. A safety window comprising:

a window sash having a movable outer frame with rigid metal cross-bars within the outer frame for forming spaces for window panes of a size too small to permit entry through the window sash by an intruder;

a fixed window frame rigidly affixed in a wall of a dwelling;

means for movably securing the window sash in the fixed window frame so the window sash moves relative to the fixed window frame between a closed position and an open position, the movable outer frame of the window sash having an internal portion inaccessible to an intruder outside the window;

a spring-biased locking bolt mounted adjacent to the fixed window frame and movable between a locked position and an unlocked position through an aperture in said fixed window frame, in which the bolt in its locked position is engaged with the fixed window frame and said internal portion of the window sash outer frame, in a tamperproof configuration, to prevent the window sash from moving to its open position, in which the bias of the spring normally urges the locking bolt toward its locked position, and in which the bolt in its unlocked position allows the window sash to move relative to the fixed window frame to an open position;

an elongated control rod secured to the locking bolt and extending interiorly through the wall of the dwelling for a distance spaced from the window to a remote position inaccessible to an intruder reaching through the window sash;

means for moving the control rod manually from said remote position for moving the control rod to release the locking bolt and thereby move the locking bolt from its locked position to its unlocked position, thereby allowing the window sash to move to its open position, in which the control rod moves the locking bolt against the bias of the spring to said unlocked position, and in which the means for moving the control rod comprises actuating means mounting interiorly in the dwelling wall and connected to the control rod so that manually applied force to the actuating means moves the control rod to thereby move the bolt to its unlocked position; and a housing mounted interiorly in the dwelling wall at said remote position and in which the actuating means is entirely contained in the housing.

15. Apparatus according to claim 14 including a rigid control rod.

16. Apparatus according to claim 14 in which the control rod in the wall passes through at least one wall stud spaced remotely from the side of the window frame.

17. Apparatus according to claim 16 including a rigid control rod.

* * * * *